United States Patent [19]

Knuppel et al.

[11] 3,938,790

[45] Feb. 17, 1976

[54] METHOD AND CONVERTER FOR REFINING PIG-IRON INTO STEEL

[75] Inventors: Helmut Knuppel; Karl Brotzmann; Hans-Georg Fassbinder, all of Sulzbach-Rosenberg, Germany; Guy Savard, Vaudreuil; Robert Lee, Montreal, both of Canada

[73] Assignee: Eisenwerk-Gesellschaft Maximilianshutte mbH, Sulzbach-Rosenberg, Germany

[22] Filed: June 15, 1971

[21] Appl. No.: 153,277

Related U.S. Application Data

[62] Division of Ser. No. 800,892, Feb. 20, 1969, Pat. No. 3,706,549.

[52] U.S. Cl. ..... 266/35; 266/41

[51] Int. Cl.[2] ..... C21C 5/42

[58] Field of Search ..... 266/35, 36 P, 34 A, 34 T, 266/34 PP, 41

[56] References Cited

UNITED STATES PATENTS

| | | | |
|---|---|---|---|
| 277,929 | 5/1883 | Reese | 266/36 P |
| 335,613 | 2/1886 | Murdock | 266/36 P |
| 372,302 | 11/1887 | Collin | 266/36 P |
| 405,766 | 6/1889 | Bookwalter | 266/35 |
| 741,505 | 10/1903 | Kirk | 266/36 P |
| 757,803 | 4/1904 | Burrow | 266/36 P |
| 1,711,738 | 5/1929 | Madorsky | 266/36 P |
| 2,829,960 | 4/1958 | Vogt | 266/41 |
| 3,241,825 | 3/1966 | Jilek et al. | 266/34 L |
| 3,321,139 | 5/1967 | Saint Martin | 266/34 L |
| 3,330,645 | 7/1967 | Moustier et al. | 266/34 PP |
| 3,397,878 | 8/1968 | Holmes et al. | 266/41 |
| 3,490,755 | 1/1970 | Lutgen | 266/34 PP |

FOREIGN PATENTS OR APPLICATIONS

| | | | |
|---|---|---|---|
| 1,450,718 | 7/1966 | France | 75/60 |

*Primary Examiner*—Gerald A. Dost
*Attorney, Agent, or Firm*—Lawrence I. Field

[57] ABSTRACT

Pig-iron is refined into steel by blowing oxygen and a protective screen of an encasing gas through injecting means located at or near the bottom of a converter containing a melt of molten metal. The encasing gas while protecting the injecting means, allows it to be consumed at substantially the same rate as the bottom of the converter so that the injecting means is not left projecting from the bottom of the converter. The encasing gas can be one which is inert to the melt or the metal of the injecting means or both, or it can be a gas which reacts sluggishly with the melt or the material of the oxygen feed pipe or both. Desirably, the oxygen jet is circular in cross-section and the encasing gas is in the form of a concentric jet.

A converter for carrying out the method is made up of a pear-shaped sheet-steel casing having a refractory lining and an inserted bottom provided with nozzles in the form of metal tubes for the oxygen and encasing gas. Preferably, a substantial portion (for example about half) of the converter bottom is free of nozzles. The nozzles can be arranged in groups and there can be rows running parallel with the tilting axis of the converter. The nozzles may also be arranged to cause circulation of the molten metal in the converter. The nozzles can be constructed to provide for swirling movement of the encasing gas. Examples of encasing gas which may be used are hydrogen, nitrogen, noble-gases, carbon monoxide, carbon dioxide, ammonia, hydrogen-fluoride, furnace-mouth gas, coke-oven gas, natural gas and other gases containing hydrocarbons.

6 Claims, 15 Drawing Figures

FIG.7
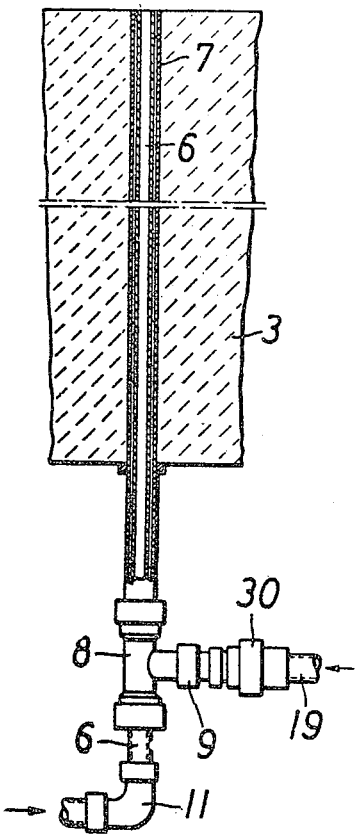
FIG.8
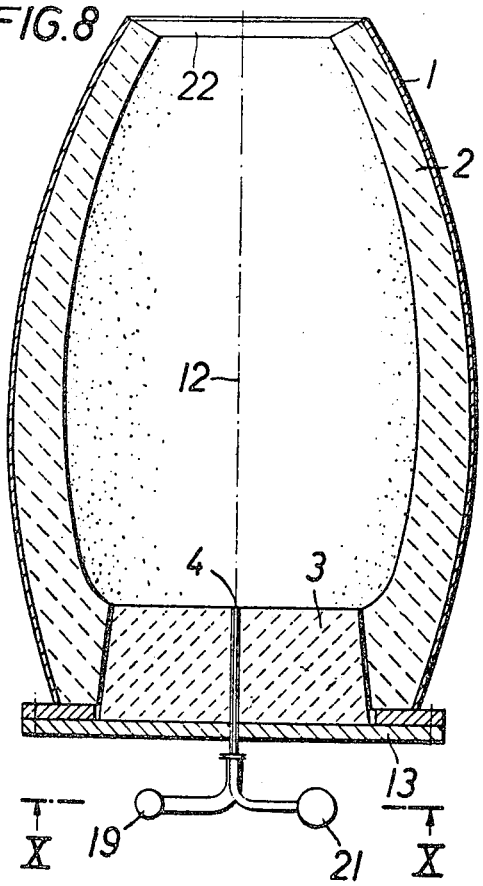
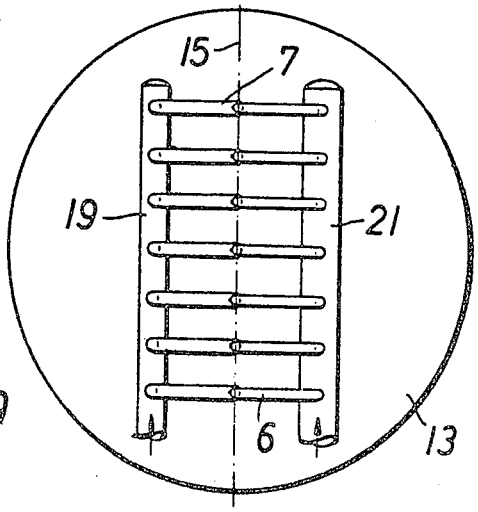
FIG.9

METHOD AND CONVERTER FOR REFINING PIG-IRON INTO STEEL

This application is a divisional of U.S. patent application Ser. No. 800,892, filed Feb. 20, 1969 now patent No. 3,706,549.

BACKGROUND OF THE INVENTION

1. Field of Invention

This invention relates to a method and a converter for refining pig-iron into steel, in which oxygen is blown into the melt from below its surface.

2. Description of Prior Art

Even about 100 years ago, the relevant literature mentioned the possibility of blowing pure oxygen instead of air through the converter bottom in the case of bottom-blown converters. The unusually rapid wear in the converter bottom associated with the blowing-in of pure oxygen prevented this proposal from being realized. Moreover, the quality of steel refined with air was adequate for decades, and there was therefore no need to use oxygen instead of air. At a later date, for the purpose of eliminating the harmful action of high nitrogen contents in steel on the welding and cold-working properties of converter-refined steel, the practice of using oxygen-enriched air was initiated. The increase in oxygen-air contamination results in a considerable loss of iron in the form of brown smoke consisting mainly of iron oxide, and the yield was correspondingly low.

Failures in attempts to blow pure oxygen into bottom-blown converters finally resulted in the known oxygenblowing process, in which pure oxygen is blown from above on to the iron melt by a lance. Although this process is very economical for manufacturing ordinary low-carbon steels, it has a number of disadvantages in comparison with the bottomblown converter. For instance, it requires costly lances which are subject to considerable wear from splashes of iron and slag and from high temperatures in the region of the stream of oxygen impinging on the surface of the bath. Moreover, the mixing of the bath, and thus the equalization of concentrations, with the oxygen-blowing process is not as good and intensive as with the bottom-blown converter. Another disadvantage is that a substantial portion of the oxygen passes to the melt through the slag, the iron-oxide content of which is correspondingly high. This, and the large volume of brown smoke, results in relatively high iron losses. Thus, in the oxygen-blowing (lance) process, the Fe content of the slag amounts to up to 30%, and the iron loss through brown smoke, to about 1.5% of the weight of the steel. This renders necessary costly gas-cleaning installations, to remove the large amounts of iron oxide contained in the waste gas.

Furthermore, in the oxygen-blowing (lance) process, only a portion of the oxygen issuing from the lance is utilized, while a not inconsiderable amount of oxygen reacts with the waste gas of the refining reactions. Since in the said oxygen-blowing process, the carbon contained in the pigiron is burned only to carbon monoxide, the waste gases still contain about 75% of the theoretical combustion heat of carbon to carbon dioxide. Although for this reason further utilization of these waste gases is advantageous, it is difficult and costly with the said process since, due to the frequent strong ejection of these converters, the gases are hard to collect and must also be subjected to costly cleaning because of the high content of brown smoke. Additional considerable heat losses arise from vaporization of the iron in the region of the burning spot, which is the cause of the brown smoke. Other disadvantages of this process arise from the absence of the stirring motion essential to the homogenization of the melt, usually produced by the blast in conventional bottomblown converters.

Because of the increased iron-oxide enrichment of the slag in this process, and the considerable increase in the amount of slag arising during the refining of a pig-iron rich in phosphorus (basic Bessemer pig-iron), in comparison with the refining of pig-iron poor in phosphorus, it is necessary, to ensure a quiet refining operation, to reduce the silicon and manganese content of the pig-iron far below the usual limits. The manganese content which is basic Bessemer pig-iron amounts, as a rule, to 1% must be reduced to a maximum of 0.6% with the oxygen-lance process, while the silicon content must be reduced to a maximum of 0.3%. This leads to a corresponding restriction in the choice of blast-furnace charge material, and thus to increased costs.

Because of the reduced bath movement in comparison with the basic Bessemer process in the bottom-blown converter, de-phosphorizing with the oxygen-lance process, with a given slag composition, is not as effective as in the bottomblown basic Bessemer converter. In order to obtain low phosphorus contents, two slags must therefore be used, resulting in a lengthening of the overall process and higher wear in the converter. Furthermore, varying amounts of the first slag, of varying composition, remain behind in the converter, and this affects the course of the second refining operation in an uncontrollable manner. The slag change also brings about considerable heat losses.

SUMMARY OF THE INVENTION

An aim of the present invention is to utilize the advantages of refining with pure oxygen in producing steel in bottom-blown converters, while eliminating the disadvantages of the oxygen-lance process, especially the large volume of brown smoke and the use of costly gas-cleaning installations rendered necessary thereby.

The invention is also concerned with a refining method combining quiet blowing with high yield, i.e. low iron losses in comparison with the oxygen-lance process. The new method aims also to provide for the highest possible utilization of the oxygen and to produce a relatively low FeO content in the slag.

Another aim of the invention is to provide for refining a phosphorus-containing pig-iron, which is relatively cheaper than a pig-iron poor in phosphorus, into a steel of high quality with a low nitrogen content, with pure oxygen, in a bottom-blown converter, producing a slag which may be utilized as a phosphorus-containing fertilizer.

Finally, the durability of the converter bottom, provided with nozzles, is increased by the method of the invention, and a higher proportion of scrap may be added in the charge or a higher tapping temperature may be achieved, or both.

The method of the invention is based on the principle of slowing down the violent reaction of the oxygen with the melt and the high wear in the mozzles and converter bottom, in such a manner that only a small amount of brown smoke, or none at all, is formed and the wear in the nozzles and bottom is reduced. According to the invention, this is accomplished by introducing a stream of oxygen into the melt through at least one nozzle located in the converter bottom, the said stream being surrounded by a haze or screen of shielding gas which reacts sluggishly, or is inert, to the melt and/or the material of the nozzle. The encasing gas acts as a coolant and slows down the reaction velocity of the oxygen emerging from the nozzle to such an extent that bottom wear and nozzle burning are reduced and substantially less brown smoke arises. By altering the ratio of oxygen to encasting or shielding gas, and by the choice of an appropriate gas, optimal conditions may be obtained in practice.

With a view to the desired slowing down of the reaction of the oxygen with the melt, and because of the cooling effect, the encasing gas should surround the stream of oxygen in the form of a concentric flow of uniform thickness. Hydrogen, which has a positive action on the solidification behaviour of the refined steel, and nitrogen, which is relatively cheap, may be considered for encasing gases, but noble gases, ammonia, gaseous hydrogen fluoride or hydrogen fluoride, carbon monoxide, carbon dioxide, or hydrogen-containing gases are also suitable as encasing gases. The vapour of a liquid which evaporates at the temperature of the bath may also be blown-in as an encasing or cooling gas. Hydrocarbons, for example, methane, propane, butane, or light oil in the form of vapour may also be blown-in as encasing gases. However, casing gases containing a high proportion of hydrocarbons, such as natural gas or coke-oven gas may also be used.

When using combustible encasing gases, to prevent a flow-back of oxygen into the encasing-gas ducts and to prevent possible damage to the mouth of the nozzle, the gases are introduced into the melt at a pressure at least half that of the oxygen pressure.

The above mentioned gases may be blown-in individually, side by side, mixed, or consecutively. For instance, refining may be carried out initially with oxygen surrounded by an encasing-gas haze of hydrogen. The resulting increased water content of the melt may be reduced later by blowing for a short period with nitrogen or argon. In this case, in addition to slowing down the oxygen reaction, the nitrogen or argon act as scavenging gases to remove the hydrogen from the melt. Thus by after-blowing for 30 to 60 seconds, the hydrogen content of the melt may be reduced to about 50%.

A somewhat unduly high nitrogen content may also be reduced by subsequent blowing with carbon dioxide or argon. As a rule, however, this is not necessary, tests having shown that the nitrogen contents arising from the use of nitrogen as an encasing gas are far below those of steel melts refined by using oxygen-enriched air. By blowing with commercially pure oxygen and nitrogen-free encasing or cooling gases, according to the method of the invention, nitrogen contents between 0.001 and 0.002% may be obtained. These values are below the minimal nitrogen contents obtainable by the oxygenlance process.

The use of hydrocarbons as encasing or cooling gases results in a relatively high hydrogen content in the steel, especially if the volume of encasing gas is increased at the end of the blow. To this extent, the method according to the invention is particularly suitable for producing steels semikilled by a relatively high hydrogen content, even if the content of other elements having an affinity for oxygen is relatively high. If a steel of this kind is killed prior to pouring in the conventional manner, e.g. with about 0.3% of silicon, and is cast into ingots, then the ingots solidify like semi-killed steels because of the relatively high hydrogen content of the melt. In addition to the pouring advantages associated therewith, a high yield of about 93% is produced in rolling.

Another advantage of the high hydrogen content arising from the encasing gas surrounding the oxygen is that with a steel having an oxygen content of 0.08%, about half of the hydrogen is burned within the melt into steam (water vapour), thus adding a large amount of heat. This makes it possible to vary the bath temperature within wide limits by adjusting the ratios of oxygen to hydrocarbon- or hydrogen-encasing gas. However, a high-temperature melt permits a correspondingly high addition of scrap and thus to a more economical operation. With the method according to the invention, the addition of scrap may be up to 35%, whereas in the traditional refining of basic Bessemer pig-iron with an oxygen-enriched blast or the oxygen-lance process, the scrap content runs to only about 20%.

The method according to the invention may also be carried out by blowing-in streams of oxygen through a plurality of jets, the said streams being surrounded by different encasing gases. Moreover, for the purpose of homogenizing and cleaning the melt, certain jets may be supplied with an inert scavenging gas, for example argon, instead of oxygen and an encasing gas. A scavenging gas introduced in this way may also be used to reduce the hydrogen content, too high for certain qualities, resulting from a prior blowing with a hydrogen encasing gas.

The method of the invention is of special significance in the refining of pig-irons containing phosphorus; in this case, in contrast to the known oxygen-lance process, a single slag having an iron content of only 10 to 15% may be used. Such low slagging of the iron, and the practically ejection-free refining process of the method according to the invention, result in a high metallic yield. Thus, for example, with a scrap addition of 30%, an iron yield of 92% was obtained in refining basic Bessemer pig-iron.

The low FeO contents of the slag, in comparison with the oxygen-lance process, has a particularly favourable effect in refining alloy pig-irons by the method of the invention. For example, when refining a chromium-alloy pig-iron, a lower final carbon content can be obtained than by the oxygen-lance process, and even a lower proportion of the chromium contained in the iron is slagged.

The quiet course of the blow also permits better utilization of the converter since, in comparison with a bottom-blown converter operated with oxygen-enriched air, may be increased by about 50%. In contrast to the oxygen-lance process or conventional refining in a bottom-blown converter, the quiet blow is not disturbed even when the pig-iron is at a relatively low temperature or has a high silicon and manganese content. Another advantage of the quiet blow is that the mouth of the converter no longer builds up with steel and slag deposits. For these reasons, and due to the elimination of the slag change, the sequence of charges may be increased which results in, among other things, a highly economical process.

It is an essential constituent of the method according to the invention that the volume and type of encasing gas and the type of material used for the oxygen feed pipe are matched in such a manner that the nozzles wear away at approximately the same rate as the refractory compound of the converter bottom in which the said nozzles are embedded. At the same time, care must be taken to ensure that solid deposits on the mouths of the nozzles, which may build up from the melt to be refined, are avoided. Such a combination of encasing gas and oxygen feed-pipe material, by means of which the effect according to the present invention may be obtained, consists in using about 3% by volume of propane as the encasing gas, related to the throughput of oxygen, and a 15% chromium steel for the oxygen feed pipe. If a copper pipe, for example, is used in place of the 15% chromium steel, the amount of propane must be reduced to about one half, which leads to a substantial increase in the formation of brown smoke. Another combination consists, for example, in using about 10% of coke-oven gas as the encasing gas (approximate composition: 55% $H_2$, 25% $CH_4$, 10% CO, remainder inert gases) and an oxygen feed pipe of 15% chromium steel. By using a steel with about 25% of chromium and 2% of molybdenum, the percentage of coke-oven gas may be reduced by about ⅓, but this again leads to increased formation of brown smoke.

If, on the other hand, for example, 20% of methane or 10% of propane and a copper oxygen feed pipe are used, heavy deposits are formed within a short time on the nozzle mouths, which reduce the throughput of oxygen and result in a substantial lengthening of the refining time. Furthermore, while the scrap is being charged-in or during the blow, the deposits on the converter bottom may be so deformed by the lumps of scrap, already present in the bath, that the flow of gases is largely cut off, which may endanger operational safety.

It has been found, surprisingly enough, that with extreme requirements for the suppression of brown smoke, higher proportions of reactive encasing gases may be used if these are admixed to an oxygen-containing gas, e.g. air. Under the above mentioned conditions, for instance, the amount of propane could be doubled by mixing propane and air in the ratio of 1:1.

On the other hand, there is no particular significance in the material used for the outer and encasing-gas pipe; simple steel pipes generally suffice. If the above mentioned conditions relating to the combination of nozzle material and encasing-gas proportions are adhered to, the life of the converter bottom with the method according to the invention is about 200 melts, whereas the bottom of the traditional bottom-blown converter has to be renewed after about 50 melts. Since the converter lining itself usually withstands 400 melts, only one bottom change is necessary with the method and converter according to the invention. However, if by chance, for example due to non-uniform distribution of the encasing gas to individual nozzles, deposits are formed on the nozzle outlet openings, such deposits may, within the scope of the method according to the invention, be melted away by brief blowing with a mixture of nitrogen and oxygen, the oxygen content of which is preferably between 10 and 20%. If the oxygen content is kept to within 10 to 20%, the said deposits are usually removed within about one minute. This is preferably accomplished by afterblowing at the end of the refining time. If the nozzles are individually adjustable, the cleaning blow according to the invention may be restricted to those nozzles on which deposits are observed. The mixture is preferably blown through both the oxygen pipe and the encasing-gas pipe.

A quiet refining operation in the converter is of critical importance for the economics of the method. It was found, surprisingly enough, that quiet refining is greatly influenced by the number of nozzles in relation to the filling level of the converter. For reasons of economics, and for the simplest possible supervision of the process, it is naturally of interest to keep the number of nozzles as small as possible. The minimal number of nozzles and the maximal permissible nozzle diameter may be calculated from the following relationships.

The total nozzle area in $cm^2$ should correspond approximately to the weight of the pig-iron to be refined in tons. Moreover, the maximal nozzle diameter is determined by the height of the bath; it should amount, at the most, to 1/35 of the depth of the bath in the refining vessel. These data are valid for the oxygen pressure of about 5 to 10 atm. normally used in refining, but are also approximately correct in other pressure ranges. By way of example, it may be stated here that the converter used had an average capacity of 30 t and a bath depth of 70 cm. This gives a maximal nozzle diameter for the oxygen feed pipe of 20 mm; the number of nozzles is then calculated from the overall nozzle area of 30 $cm^2$ as being 10.

Nozzles larger than those calculated from the foregoing relationships may be used if the axis of the nozzles is, rather than being perpendicular to the surface of the bath, at a certain angle of inclination to the longitudinal axis of the converter, or is built into the wall of the converter parallel with the surface of the bath. If the nozzles are incorporated obliquely, e.g. at an angle of about 30° to the vertical arrangement, the maximal nozzle diameter may be increased by about 20%. If the nozzles are incorporated horizontally into the side wall of the converter, the nozzle diameter calculated in accordance with the above relationship may even be doubled. In this case, therefore, only 3 nozzles with a diameter of 36 mm are needed for the oxygen feed pipe for a 30 t melt.

The oxygen and the encasing gas may be blown-in at one or two opposing locations in the converter bottom. This imparts to the melt a definite circulating movement, which is of considerable significance for the thorough mixing of the melt, in view of the small volume of gas as compared with the traditional bottom-blown converter. When blowing-in takes place on one side, the flow of metal above the nozzles is in an upward direction and, in the remainder of the converter, in a downward direction, whereas if the blowing-in is on two sides, the outside of the melt rises while the melt at the center of the converter flows downwards. The cooperation of the oxygen and the encasing gas with the circulating movement induced by the type of gas supply over the converter bottom leads to a rapid exchange of material, lower iron-oxide contents in the slag, and thus to very low iron losses.

The method according to the invention is preferably carried out in a converter having the following characteristics. It has a pear-shaped steel casing with an inserted bottom and a refractory lining. The nozzles are located in the converter bottom, a substantial portion of which is free of nozzles. The result of this is that the melt rises in the nozzle region, sweeps partly through the layer of slag, and is drawn down again in the nozzle-free area of the bottom. The nozzles are preferably arranged entirely in one half of the bottom, and may be arranged in groups so that a strong suction arises at the converter bottom. Satisfactory mixing of the gases introduced and the melt also leads to a sort of gas-lift effect and thus to rapid rising of the melt above the nozzles. The distance between individual groups of nozzles is preferably selected in such a manner that the funnel-shaped upward currents intersect to some extent just below the surface of the bath, thus ensuring near the surface of the melt a uniform distribution of gases which contributes to a reduction in ejection.

Special advantages are obtained when all of the nozzles on the diameter of the bottom lie parallel with the tilting axis of the converter. A converter of this kind, in which the nozzles are arranged along a central strip on the bottom, may be made rotationally symmetrical with its longitudinal axis, the rows of nozzles terminating at a distance from the side walls of the converter which is dependent, in the individual case, upon the number of nozzles. The rotationally symmetrical converter with a row of nozzles lying, for example, parallel with the axis of rotation (tilting axis) and along the diameter, makes it possible to tilt the converter in both directions. In this way, slag may be removed by tilting in one direction, while the melt may be tapped by tilting in the other direction. During the tilting, gas is fed continuously through the nozzles to prevent them from becoming blocked and, above all, to prevent them from coming into contact with the steel and the highly aggressive slag.

If the nozzles are arranged obliquely, it then becomes possible, with the method to remove the refining slag by means of jets of gas impinging obliquely on the surface of the bath when the converter is in the horizontal position. Slag removal may then be effected by means of hot gases, for example, the combustible gases of an oxygen/hydrocarbon-gas mixture which forms at the outlet apertures of the nozzles when the oxygen is blown through the inside pipe and hydrocarbon gas through the outside pipe.

For the purpose of slag removal, the converter need merely be tilted beyond the horizontal position, so that the level of the bath is at an acute angle to the longitudinal axis of the converter and to the jet of gas issuing from the nozzles. The degree of tilt is determined in the individual case by the curvature of the converter lining or casing and, is greater in the case of a non-rotationally symmetrical converter than in the case of a rotationally symmetrical converter.

Particularly satisfactory slag removal conditions are obtained if the longitudinal axes of some or all of the nozzles are at an angle to the longitudinal axis of the converter so that the emerging jets of gas impinge upon the slag cover or bath surface at an acute angle when the rotationally symmetrical converter is in the horizontal position. Individual nozzles among those arranged along a central strip may be inclined, or several nozzles with inclined axes may be located in one half of the bottom. The said nozzles may also be inclined at different angles. Tests have shown that the nozzles may, with advantage, be inclined in such a manner that their longitudinal axes intersect in the upper part of the converter with the longitudinal axis thereof, so that, when the converter is on its side, the gas jets impinge on the slag or on the surface of the bath approximately between the center of the bath surface and the mouth of the converter. If only a few nozzles are inclined in relation to the longitudinal axis of the converter, these nozzles may have a separate gas connection, so that they may be supplied with gas independently of the other nozzles. The slag-removal nozzles arranged at an angle to the longitudinal axis of the converter may also be operated at a pressure which is substantially higher than the gas pressure during refining and which may amount, for example, to 60 atm., whereas the gas pressure for refining is only 6 atm. If the nozzles are at different angles of inclination, this produces a more or less widely fanned-out jet which, at a correspondingly high pressure, provides effortless and rapid slag removal.

Commercially pure oxygen is generally used for the execution of the method. At 99.7% purity, and with nitrogen-free encasing gases, nitrogen contents of less than 0.002% are obtained in the finished steel. However, a higher nitrogen content is required for certain qualities of steel. In contrast to the oxygen-lance process, the method according to the invention offers the advantage of producing higher nitrogen contents in the steel by mixing nitrogen with the oxygen. The simplest way of doing this, of course, is to mix air with oxygen. If, for example, nitrogen contents between 0.008 and 0.10% are required in the liquid steel, this can be obtained with 4% of nitrogen in the oxygen. It is also within the scope of the present invention to add the additional nitrogen only towards the end of the refining, approximately during the last ⅓ of the process. The increase in nitrogen may also be obtained by using ammonia as the encasing gas.

BRIEF DESCRIPTION OF THE DRAWINGS

The invention is explained in greater detail hereinafter with the aid of practical examples illustrating preferred embodiments. In the drawings:

FIG. 7 shows nozzles according to the invention for oxygen and encasing or cooling gas, on an enlarged scale incorporating a non-return valve;

FIG. 8 is a vertical longitudinal section through a rotationally symmetrical converter according to the invention;

FIG. 9 is a horizontal section along the line X—X in FIG. 8;

DESCRIPTION OF THE PREFERRED EMBODIMENTS

Figure 1:
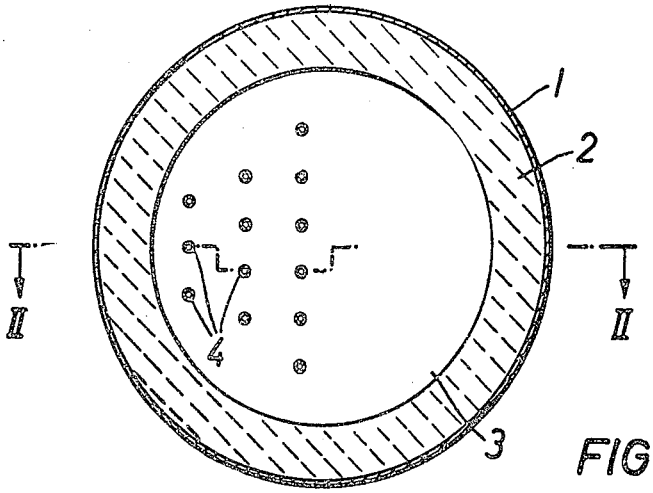
FIG. 1 is a plan view of a horizontally sectioned converter with an example of the construction of a converter bottom according to the invention.
Figure 2:
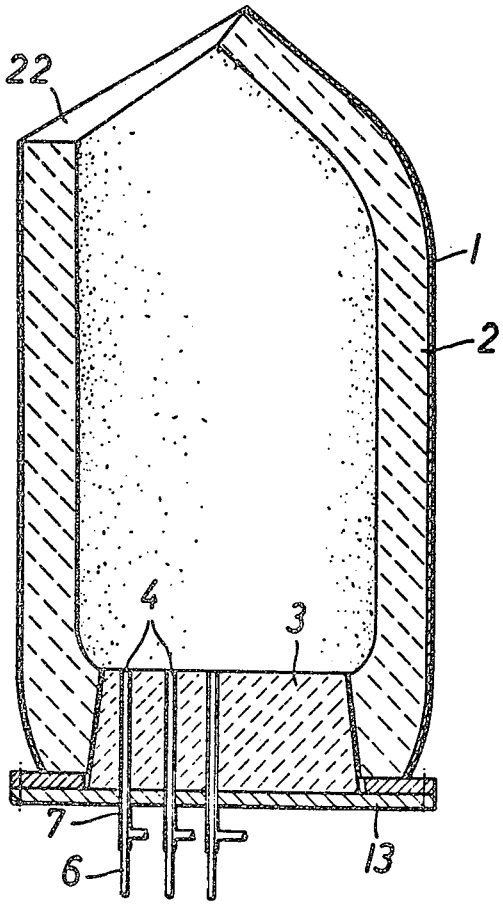
FIG. 2 is a vertical section through the converter in FIG. 1, along the line II—II.

The converter according to the invention (FIG. 2) consists of the usual steel casing 1 having a refractory lining 2 and a refractory bottom 3 on a bottom plate 13. The one-sided arrangement of nozzles 4 in bottom 3 has the advantage that when the converter is tilted to the right in the drawing — for charging, the nozzles are not damaged and the scrap can be accommodated in the nozzle-free half of the bottom. Moreover, when the converter is on its side, it can be filled up to the level of the first row of nozzles. Finally, and again when the converter is on its side, the scrap in the lower, nozzle-free half of the converter may be pre-heated by introducing oxygen and hydrocarbon through nozzles 4, as in an open-hearth furnace. When the converter is on its side, the nozzles are protected from melting by the introduction of a gas, preferably an inert gas.

In the converter according to the invention, the bottom half provided with nozzles 4 may also be made interchangeable, while the other half of the bottom is a fixed part of the lining.

Figure 3:
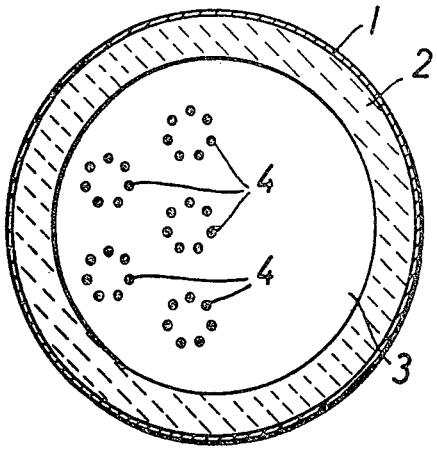
FIGS. 3 to 6 are converter bottoms with differently arranged nozzles.
Figure 4:
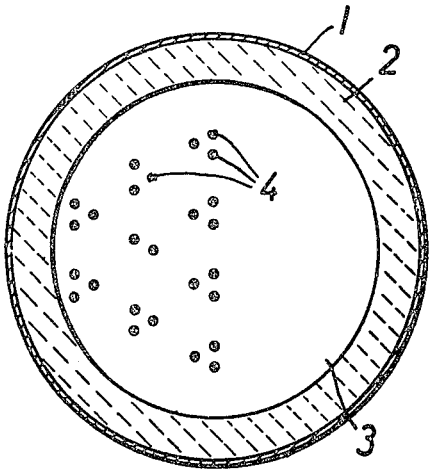
Figure 5:
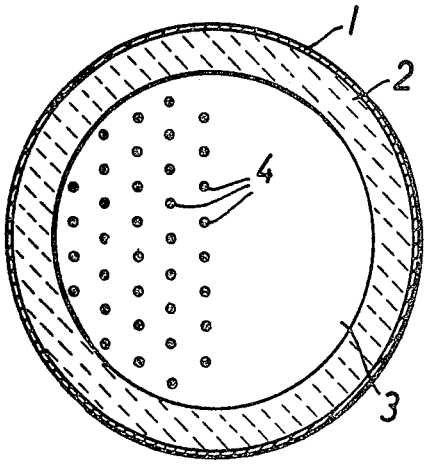
Figure 6:
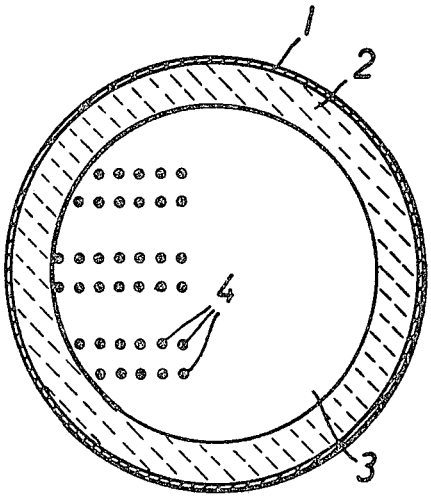

The nozzles may also be arranged in circular or triangular groups (FIGS. 3, 4) in several rows of two (FIG. 6) or may also be distributed uniformly over one half of the bottom (FIG. 5). The relatively great distance between individual nozzles or groups of nozzles results in a nozzle-free space in the converter bottom, allowing unimpeded access of the metal to the nozzles and to the gas/metal jets forming above the nozzles. The nozzles (FIG. 7) consist of an internal pipe 6 for oxygen and a concentric external pipe 7 for the encasing or cooling gas. The pipe ends projecting from the converter bottom carry a T-shaped connecting piece 8 with an adaptor 9 for the encasing or cooling gas and a connection 11 for the oxygen.

The converter illustrated in FIG. 8 is rotationally symmetrical in relation to the longitudinal axis 12 of the converter and also consists of a steel-plate casing 1 and a refractory lining 2. Inserted into the converter 1,2 and resting upon a bottom plate 13, is a bottom 3 of refractory material, for example burned coal-tar dolomite. The converter bottom 3 has a plurality of nozzles 4 arranged in a row along bottom diameter 15 and parallel with the tilting axis (not shown) of the converter. Nozzles 4 consist of an external pipe 7 and a concentric internal pipe 6 which are connected to a gasline for the encasing gas 19 and a common oxygen line 21.

Figure 11:
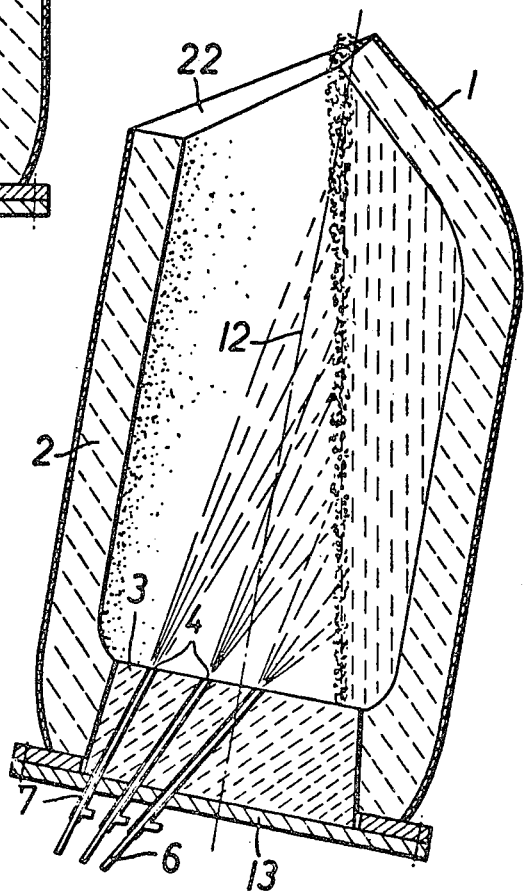
FIG. 11 shows a converter, with a plurality of nozzles at different angles, in the tilted position during slag removal.

The refining of pig-iron with the converter shown in FIGS. 8,9 is accomplished by blowing pure oxygen through internal pipe 6, and an encasing gas, for example propane, through external pipe 7 into the converter which is approximately half full of pig-iron. The hydrocarbon gas acts as an encasing gas and prevents rapid melting away of the nozzles mouths an thus premature wear of converter bottom 3. When the refining slag resulting from the oxidation products and the additives is to be removed, the converter is tilted out of the position shown in FIG. 8 to beyond the horizontal, so that the level of the bath, as shown in FIG. 11 for another converter, is at an acute angle to the longitudinal axis 12 of the converter. During the tilting, blowing with oxygen and propane is continued in order to prevent damage to nozzles 4 by the melt of the slag.

Since hydrocarbons are gases which burn with a high development of heat, a very hot flame is produced. In accordance with the arrangement of the nozzles, a widely fanned-out jet of gas is produced which, at the high blowing pressure, forces the slag from the surface of the bath to the mouth of the converter. The high temperature of the jet of combustion gas produces a very liquid slag which easily runs out of the converter.

Figure 10:
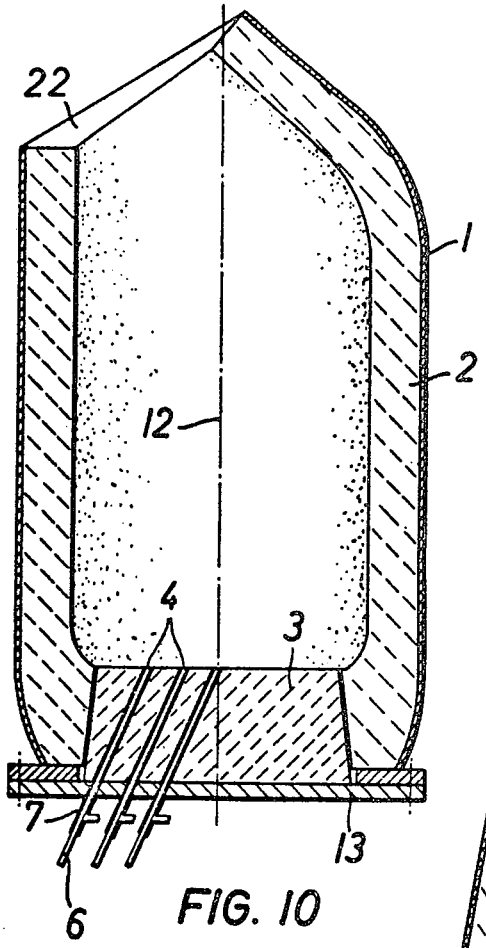
FIG. 10 shows a converter according to the invention with nozzles inclined to the longitudinal axis of the converter.

The example illustrated in FIG. 10 contains a plurality of nozzles 4 in converter bottom 3, these nozzles being at an angle to the longitudinal axis 12 of the converter. A main advantage of these inclined nozzles 4 is that they produce a relatively deeply staggered jet of combustion gas during slag removal in the tilted position, which, as shown in FIG. 11, moves the slag towards the mouth of the converter and then out of the converter. However, in addition to nozzles 4 running at an angle to the axis of the converter, but parallel with each other, the converter bottom 3 may also contain a plurality of nozzles running parallel with the longitudinal axis 12 of the converter. In this case, however, it is advisable to provide the inclined nozzles with their own gas connections, in order to be able to vary the pressure, and if necessary the type, of the gases issuing from the inclined nozzles independently of the other nozzles.

Another improvement in slag removal is obtained if the inclined nozzles do not run parallel with each other, but are at different angles to longitudinal axis 12 of the converter. In this case, the jets of gas, issuing from individual nozzles 4, cover most of the slag and bath surfaces in the tilted position according to FIG. 11, so that the slag may be very quickly removed from the converter. Individual adjustment of individual nozzles, or rows of nozzles, allows very rapid slag removal without any assistance from mechanical means. Furthermore, the converter is in a tilted position in which, as may be seen in FIG. 11, there is no longer any danger of steel running out of the converter with the slag, whereas in removing the slag from the traditional converter, the said converter must be tilted until the level of the bath reaches at least the upper edge of the lower part of the converter mouth, if the slag is to be poured off the surface of the bath as far as possible under the influence of gravity. In this way, considerable steel losses cannot be avoided.

Figure 12:
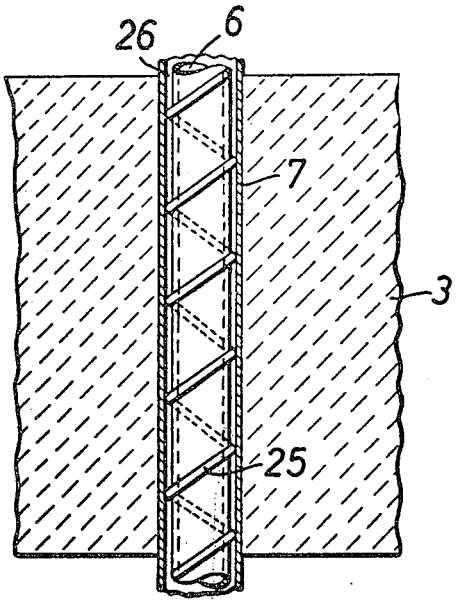
FIG. 12 is an enlarged representation of a nozzle according to the invention with a wire spiral used as a spacer between the nozzle pipes.
Figure 13:
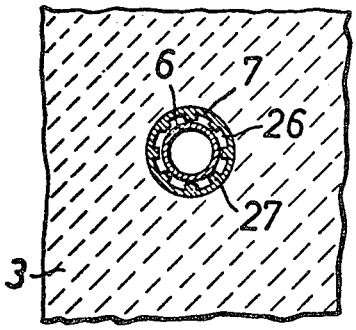
FIG. 13 is a cross-section through a nozzle according to the invention with spacer ribs.

As already mentioned in connection with FIG. 7, the nozzles consist of an internal pipe 6 for oxygen and an external pipe 7 for encasing gas. Located between the two pipes 6,7 is a wire spiral 25 which maintains a constant annular space 26 between the two pipes 6 and 7 (FIG. 12). The said wire spirals also cause the encasing or cooling gas to enclose the oxygen jet, closely and uniformly, when it leaves oxygen pipe 6, since the said wire spirals 25 impart a twist to the said encasing gas. Instead of a separate wire spiral 25, encasing-gas pipe 7 may also be provided with internal ribs 27 acting as spacers (FIG. 13).

Figure 14:
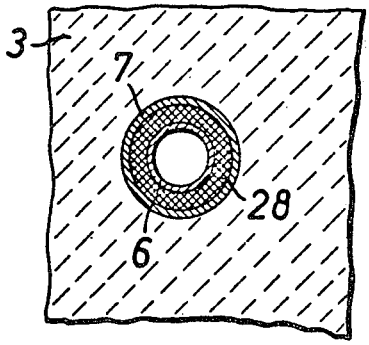
FIG. 14 is a cross-section of a nozzle according to the invention with porous refractory material in the annular space between the two nozzle pipes.

The annular space 26 between the oxygen pipe and the encasing-gas pipe may also be filled, as shown in FIG. 14, with a porous material 28, for example, a porous sintered metal or a refractory substance.

Figure 15:
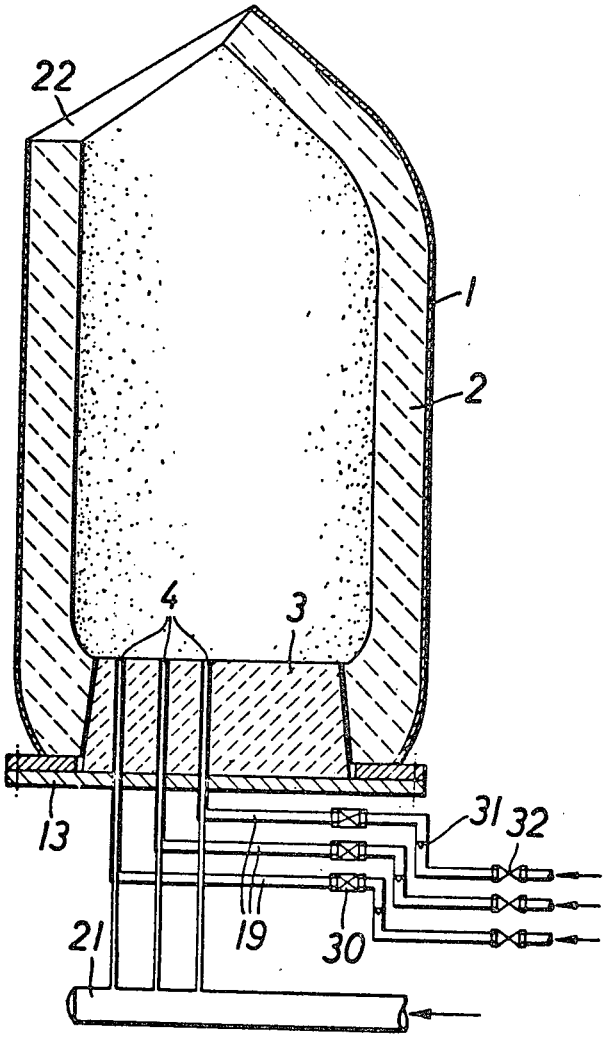
FIG. 15 is a schematic illustration of a converter according to the invention, having a common oxygen line for the oxygen pipes and individual connections for the encasing-gas pipes.

For the purpose of increasing operational safety and preventing the entry of oxygen into the encasing-gas system in the event of one or more oxygen pipes becoming blocked, a non-return valve 30 (FIGS. 7,15) is located in line 19 to encasing-gas pipe 7. This non-return valve is set to a specific pressure at which it closes immediately. While the oxygen pipes are generally connected to a common oxygen line, the encasing-gas pipes preferably have their own supply lines with flow meters 31 and regulating valves 32. In this case, the supply of encasing gas to each nozzle may be adjusted individually, so that the said nozzle may be fed with different encasing gases and different volumes of encasing gas.

In an operational melt in a bottom-blown converter according to the invention, the nozzles were arranged in a converter bottom made of coal-tar dolomite in four rows of five nozzles each, 20 nozzles in all, the oxygen pipes thereof having an inside diameter of 12 mm and the encasing-gas pipes an inside diameter of 18 mm. The oxygen pipes were made of a steel consisting of 18% chromium, 10% nickel, and the remainder mainly iron. The wall thickness was about 1 mm. This left a concentric annular gap of about 1 mm between the internal and external pipe for the introduction of the propane. The encasing-gas pipe was a steel pipe having a wall thickness of about 2 mm. The encasing-gas pipes were connected to a nitrogen line, a propane line, and an air line.

6 tons of scrap and then 21 tons of liquid basic Bessemer pig-iron at 1250°C and with the following analysis were charged into the converter in the tilted position:

3.5% carbon
0.6% silicon
1.7% phosphorus
1.0% manganese
0.50% sulphur
remainder mainly iron.

During charging, both nozzle tubes were supplied with atmospheric air at 3 atm.

After charging, the air supply was shut off and propane was fed to the encasing-gas pipe and oxygen to the oxygen pipe. After the propane had ignited, the converter was returned to the vertical position and 3 t of lime were added. The volume of propane gas amounted to 170 $Nm^3/h$ and the volume of oxygen to 4000 $Nm^3/h$. After about 10 minutes, an additional 2 t of scrap were charged from above into the blowing converter. The volume of oxygen was then increased to 5000 $Nm^3/h$ while the volume of propane gas was kept constant. During the entire blowing time, the converter blew quietly without developing any appreciable noise and without ejection. After about 17 minutes of blowing time, the converter was tilted and at the same time the internal pipe was charged with air, while nitrogen was fed to the external pipe. On the basis of a chemical analysis of a sample, the converter, as described above, was tilted back up again and was afterflown for about 60 seconds, in order to obtain the desired steel composition. The converter was then tilted to the horizontal again and the slag was removed. The composition of the slag was as follows:

14% Fe (in the form of FeO)
45% CaO
16% $P_2P_5$
remainder MnO, $SiO_2$

The steel was tapped at 1620°C and analyzed as follows:

0.02% carbon
0.15% manganese
0.026% phosphorus
0.023% sulphur
0.002% nitrogen
0.0010% hydrogen The advantages of the method according to the invention, as compared with the known oxygen-lance process, are the substantially lower iron-oxide content of the slag, which therefore attacks the converter lining less, resulting in a longer life for the lining. In spite of the low FeO content of the slag, very good de-phosphorizing is obtained, as shown by the foregoing analysis. As a result of optimal utilization of the oxygen introduced into the melt, blowing times are short, the blow is quiet in spite of the high proportion of scrap, and production is therefore increased. Finally, because of the quiet blow, the method according to the invention is almost independent of the pig-iron composition, whereas the known oxygen-lance process requires a pig-iron analysis held within narrow limts and thus the use of pig-iron mixers to equalize fluctuations in analysis.

We claim:

1. A converter consisting essentially of a sheet-steel casing with a refractory lining and an inserted nozzle bottom in which a substantial portion of the converter bottom is free of nozzles, and in which the nozzles are each made up of an oxygen pipe and a concentric encasing gas pipe, and in which a non-return valve is arranged in the feed line to each encasing-gas pipe.

2. A converter consisting essentially of a sheet-steel casing with a refractory lining and an inserted nozzle bottom in which a substantial portion of the converter bottom is free of nozzles, and in which the nozzles are each made up of an oxygen pipe and a concentric encasing gas pipe, and in which the oxygen pipes are connected to a common oxygen line and the encasing-gas pipes each have their own feed line.

3. A converter according to claim 2, in which each of said encasing gas pipes is provided with a regulating valve in each said pipe, whereby the flow in each pipe may be controlled by said valve.

4. A converter according to claim 2, in which each of said encasing gas pipes is also provided with a flowmeter in each said pipe.

5. The converter of claim 1 in which said oxygen pipes are of a steel containing at least about 15% chromium.

6. The converter of claim 2 in which said oxygen pipes are of a steel containing at least about 15% chromium.

* * * * *